US011677156B2

(12) United States Patent
Ali et al.

(10) Patent No.: US 11,677,156 B2
(45) Date of Patent: Jun. 13, 2023

(54) COMPACT HIGH-PERFORMANCE DEVICE-INTEGRATED ANTENNAS

(71) Applicant: TEXAS INSTRUMENTS INCORPORATED, Dallas, TX (US)

(72) Inventors: Hassan Omar Ali, Murphy, TX (US); Richard George Wallace, Stockholm (SE); Benjamin Stassen Cook, Los Gatos, CA (US); Swaminathan Sankaran, Allen, TX (US); Sanjay Mohan, Dallas, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 17/328,082

(22) Filed: May 24, 2021

(65) Prior Publication Data

US 2022/0166144 A1 May 26, 2022

Related U.S. Application Data

(60) Provisional application No. 63/118,203, filed on Nov. 25, 2020.

(51) Int. Cl.
*H01Q 1/22* (2006.01)
*H01Q 9/04* (2006.01)

(52) U.S. Cl.
CPC ..... *H01Q 9/045* (2013.01); *H01Q 1/2283* (2013.01)

(58) Field of Classification Search
CPC ..... H01Q 9/045; H01Q 1/2283
USPC ..... 343/700 MS
See application file for complete search history.

(56) References Cited

U.S. PATENT DOCUMENTS

2018/0358292 A1* 12/2018 Kong ..... H01L 23/315
2018/0366831 A1* 12/2018 Cai ..... H01Q 9/16
2019/0088603 A1* 3/2019 Marimuthu ..... H01L 23/49816
2019/0109103 A1* 4/2019 Chiang ..... H01Q 21/08
2020/0373259 A1* 11/2020 Koller ..... H01P 3/003

* cited by examiner

*Primary Examiner* — Peguy Jean Pierre
(74) *Attorney, Agent, or Firm* — Frank D. Cimino

(57) ABSTRACT

An antenna integrated in a device package is formed such that at least a portion of the antenna is elevated with respect to a substrate of the device package. The entire antenna and its functionality are positioned within a space extending vertically upwardly from a footprint of the substrate that contains circuitry of the device. The boundary of the space is defined by the perimeter of an over mold positioned on the substrate and encapsulating the circuitry.

20 Claims, 9 Drawing Sheets

COMPACT HIGH-PERFORMANCE DEVICE-INTEGRATED ANTENNAS

CROSS-REFERENCE TO RELATED APPLICATION

This application claims priority on U.S. provisional application No. 63/118,203, entitled "DEVICE-INTEGRATED STILTED AND METAL-SPUTTERED ANTENNAS," filed Nov. 25, 2020, the content of which is incorporated by reference herein in its entirety.

FIELD OF DISCLOSURE

This disclosure relates generally to a device package, and more particularly to one or more antennas integrated in a device package.

BACKGROUND

It is common in the electronics industry to encapsulate one or more semiconductor devices in a package to protect the circuitry of the device(s) from environmental and handling damage. The package also provides a convenient method for attaching the semiconductor device(s) to an end use device.

To enable wireless communication features, an antenna for such small device needs to fit in the limited space available. Device package miniaturization, in response to demand for smaller end use devices, has led to a corresponding miniaturization of associated antennas. As antennas become smaller, however, their performance characteristics tend to deteriorate. For example, radiation efficiency may decrease; gain and operational bandwidth may also be reduced. One approach in antenna miniaturization has been to utilize surface space external to the package containing the circuitry of the package device(s), e.g., a portion of a printed circuit board (PCB) external to such package, to accommodate any portion or functionality of the antenna. Such approach, however, limits miniaturization and cost reduction of end-use devices. Device performance may also suffer when the antenna utilizes external structures on the end-use device, as the device relies on an uncontrolled antenna function implemented by an end user. Such approaches also tend to lead to a less compact end-use system. A solution to these problems is desirable.

SUMMARY

In accordance with an example, a device package, e.g., a semiconductor device package, comprises a substrate carrying circuitry and an interconnection; a mold encapsulating the substrate; and an antenna. The antenna includes a main segment positioned above the substrate and electrically coupled to the interconnection. The main segment is completely positioned within a space extending vertically upwardly from a footprint of the substrate and which space is defined by the perimeter of the mold. In an example, the antenna also includes a connecting segment electrically coupled to the main segment and extending downwardly terminating in an end that is electrically coupled to the interconnection.

In accordance with an example, a method comprises forming a substrate carrying circuitry and an interconnection; encapsulating the substrate with a mold; and forming an antenna of a package device, e.g., a semiconductor package device, within a footprint extending vertically upwardly from the substrate and within the mold of the device package. At least part of the antenna is positioned above the substrate.

In accordance with an example, a device comprises a device package, e.g., a semiconductor device package, including a substrate carrying circuitry and an interconnection; and an antenna including a main segment positioned above the substrate and electrically coupled to the interconnection. The main segment is completely positioned within a space defined by a vertically-extending footprint of the substrate, and the perimeter of the space is defined by the perimeter of the device package. In an example, the antenna also includes a connecting segment electrically coupled to the main segment and extending downwardly terminating in an end that is electrically coupled to the interconnection.

These and other features will be better understood from the following detailed description with reference to the accompanying drawings.

DETAILED DESCRIPTION

Figure 1A:
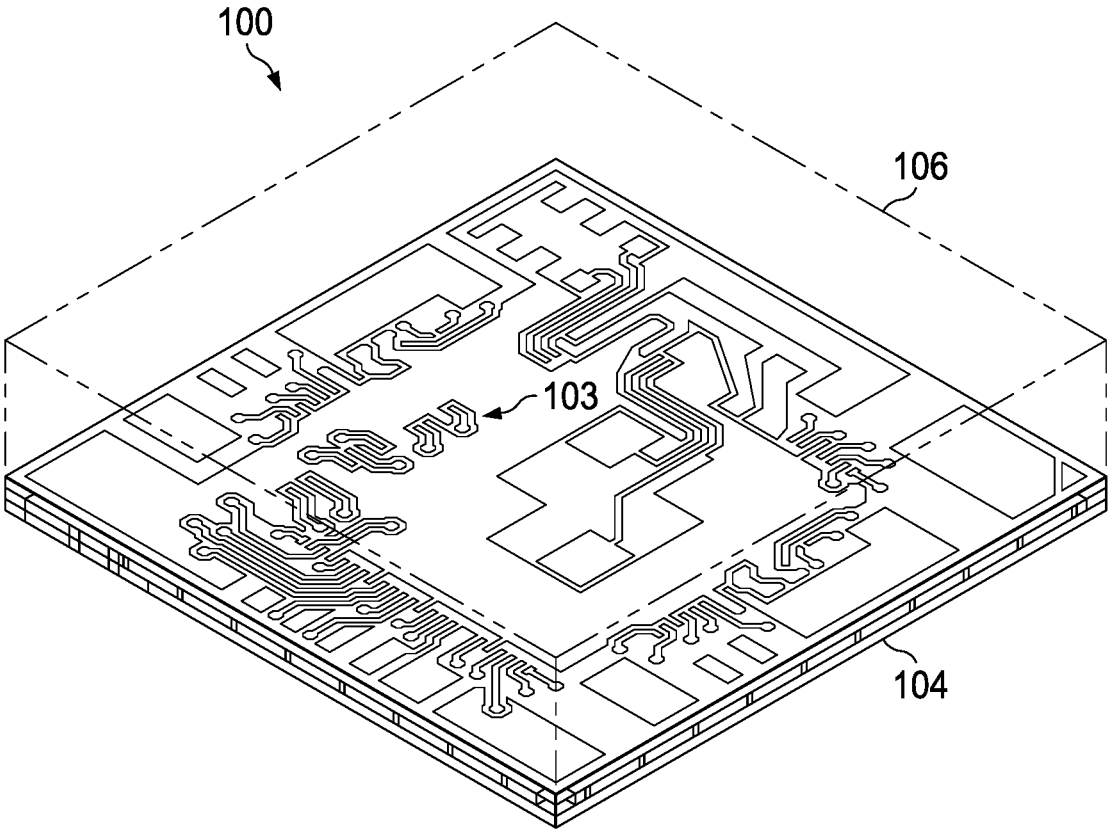
FIGS. 1A and 1B are perspective and top views, respectively, of a device package and motherboard assembly.

Specific examples are described below in detail with reference to the accompanying figures. These examples are not intended to be limiting. In the drawings, corresponding numerals and symbols generally refer to corresponding parts unless otherwise indicated. The objects depicted in the drawings are not necessarily drawn to scale.

The terms "connected," "coupled", "interconnection" and the like, as used herein, include direct connection or coupling between two elements, indirect connection or coupling through one or more intervening elements, as well as contactless coupling, which includes any suitable type of electrical coupling, e.g., magnetic, capacitive, hybrid, or the like. Relative terms such as "top," "above," "vertical," "horizontal" and derivatives thereof indicate relative position with respect to the orientation being described or as shown in the drawing under discussion; such terms do not indicate absolute position or orientation. Directional terms, i.e., "upwardly," "downwardly" and the like are also relative to the context of what is being described. These terms do not require that any device or structure be constructed or operated in a particular orientation.

In example arrangements, the problem of implementing a high-quality, low-cost, compact antenna with flexible configuration options in a semiconductor device is solved by utilizing space above the device package substrate on which circuitry of the device is disposed. The antenna may be formed using any of various low-cost manufacturing techniques, i.e., panel-based assembly, metal sputtering, or printing, e.g., ink-jet printing.

In an example, a main, e.g., meandering, segment of the antenna, is electrically coupled to the substrate. The coupling may be contactless between the main segment and the substrate or via a connecting segment that is electrically coupled between the main segment and the substrate. The coupling of the main segment to the connecting segment and/or the coupling of the connecting segment to the substrate may be physical or contactless. The main segment is positioned above the substrate within a space extending vertically from the footprint of the substrate, thus increasing the available space on the substrate for other components. The antenna can be formed in any of various shapes to achieve desired radiation and/or other performance-related characteristics. Advantageously, the antenna, its connections and its functionality are fully integrated on, and within the vertical extension of, the footprint without sacrificing antenna performance. Such arrangements enable further module and package miniaturization and integration that may result in lower production costs.

Figure 1B:
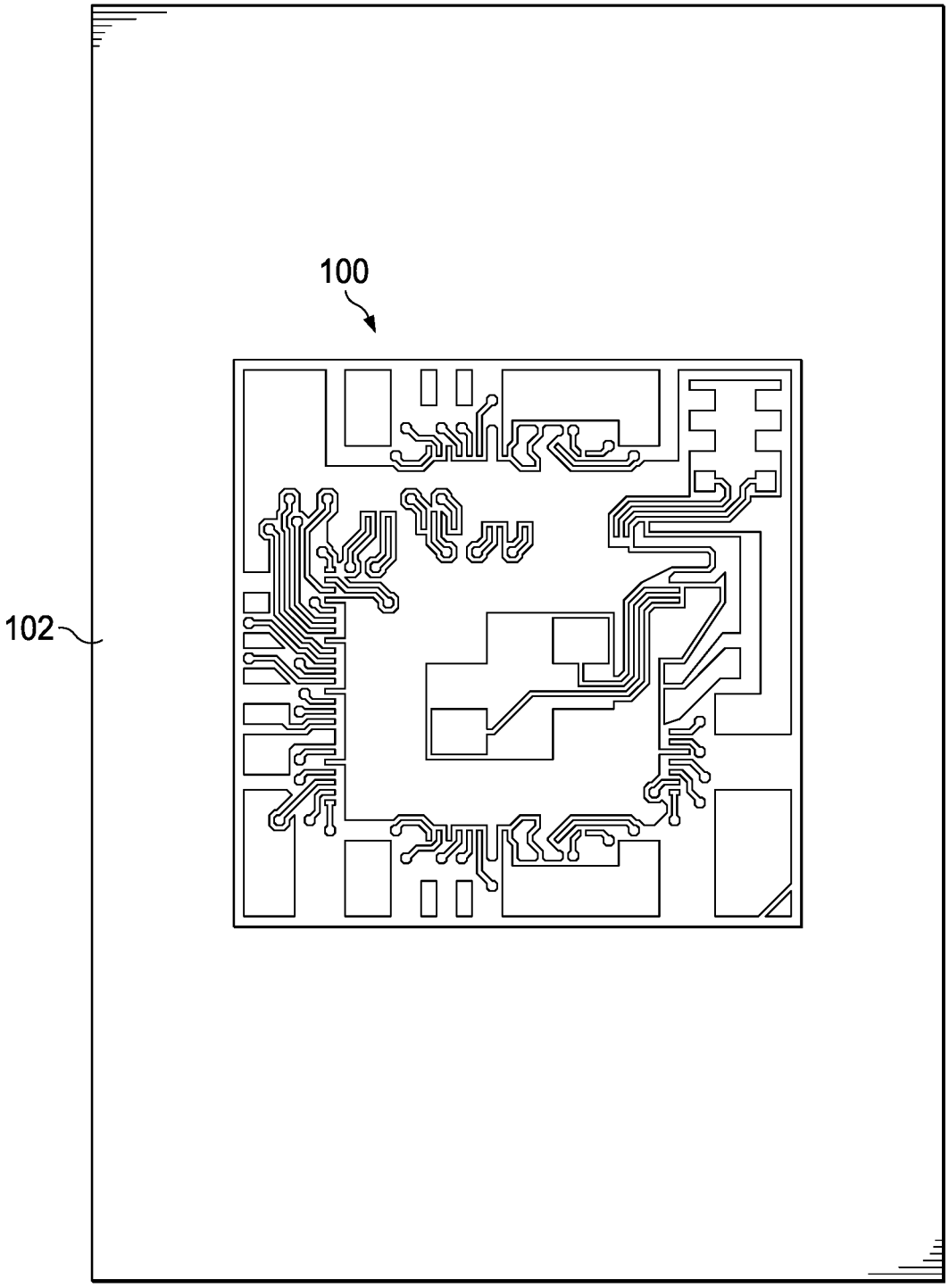

FIGS. 1A and 1B are diagrams respectively showing perspective and top views of a device package 100, e.g., a semiconductor device package, disposed on a motherboard 102, which may be of a larger electronic device, e.g., personal computer, tablet, mobile phone or the like. Motherboard 102 includes various other electronic components and connections. Device package 100 includes a substrate 104, e.g., a printed circuit board (PCB) substrate, that forms the base of device package 100. Electronics, traces and circuits (collectively, "circuitry") 103 of one or more semiconductor devices contained within the device package 100 are fabricated on, or attached to, substrate 104. The top surface of substrate 104 defines the its footprint. An over mold material 106 ("mold" hereinafter) that encapsulates and protects the circuitry 103 as is known in the art. Mold 106 may be any material suitable for use in a semiconductor environment, e.g., an epoxy resin molding compound. A metal may be selectively deposited on the exterior surface of mold 106 to facilitate dissipation of heat generated by the semiconductor device as is also known in the art.

To enable communication with other remote devices and components, device package 100 includes an antenna 108, as shown in FIGS. 2A-4C.

Figure 2A:
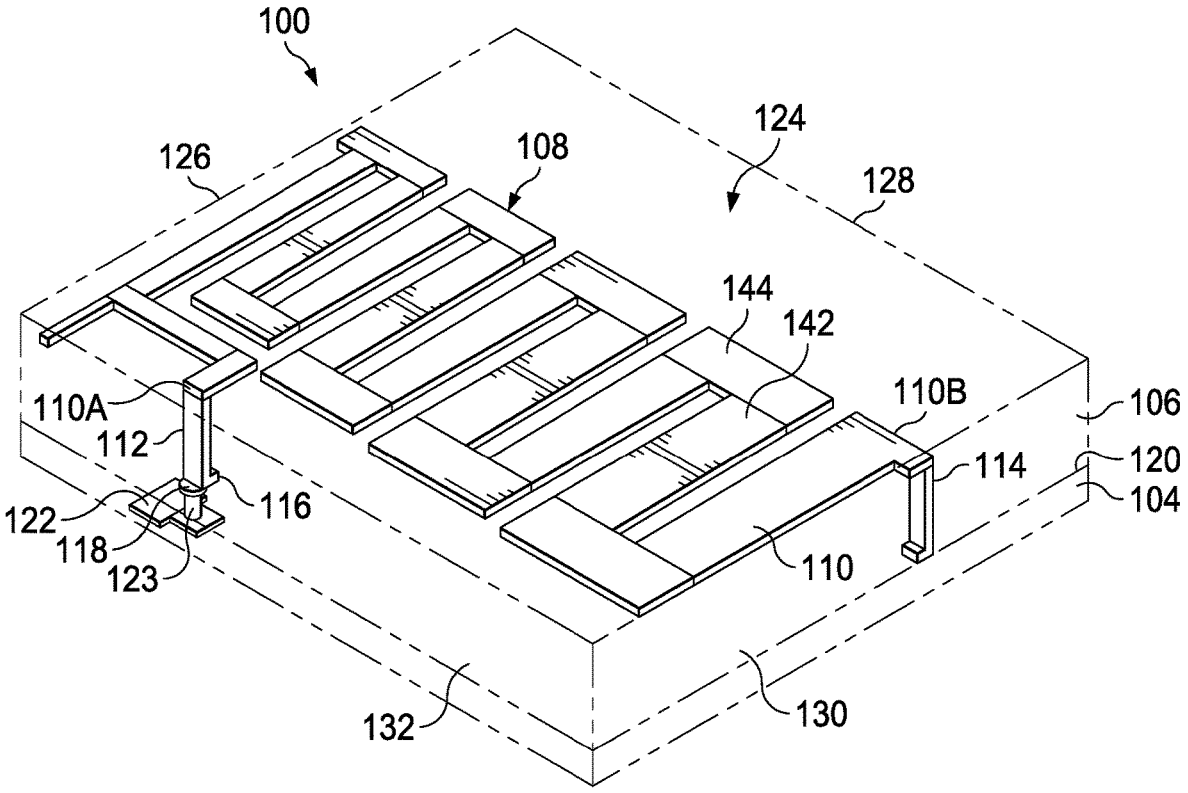
FIGS. 2A, 2B and 2C are perspective, top and side views, respectively, of a device package with an antenna formed in a mold of the package.
Figure 2B:
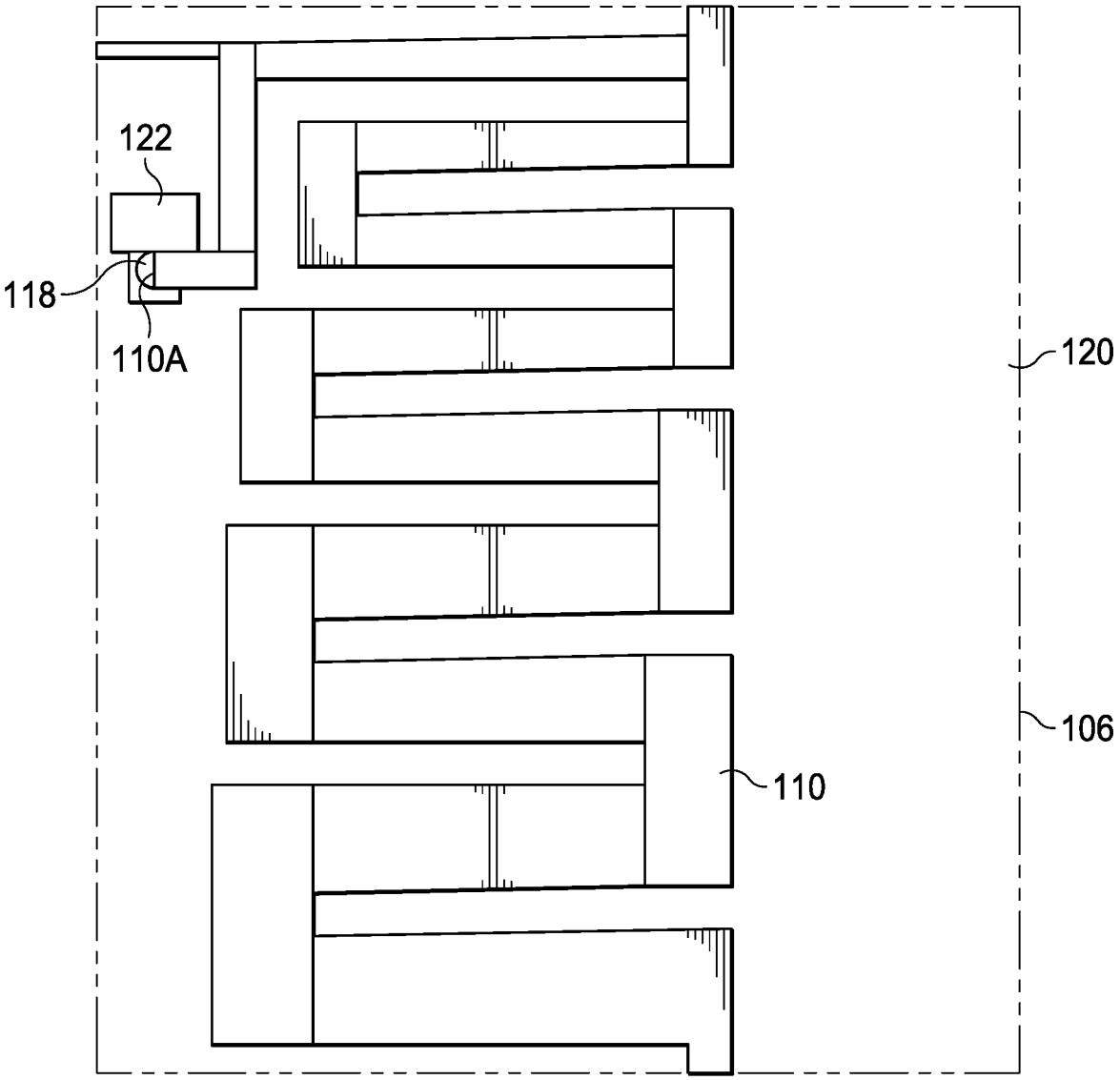
Figure 2C:
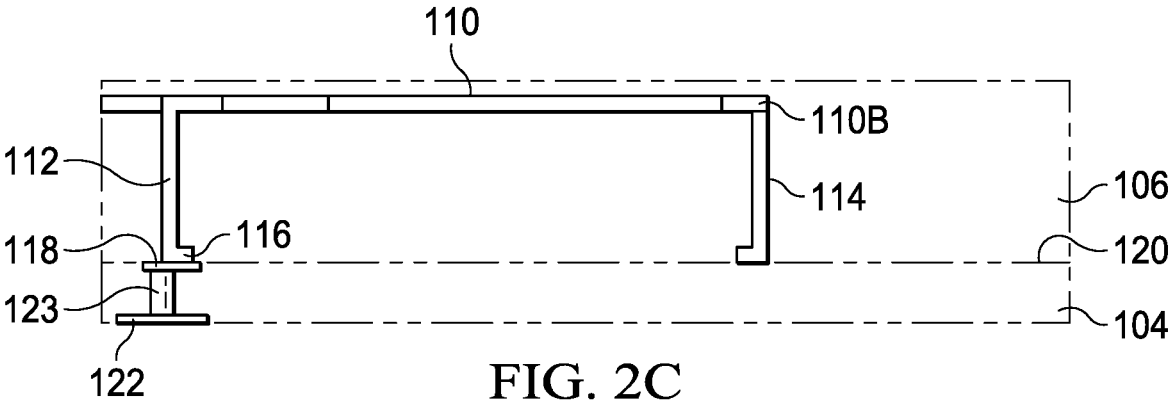

FIGS. 2A, 2B and 2C (collectively, FIG. 2) are diagrams of device package 100 and its antenna 108 configured and arranged according to an example. FIG. 2A is a perspective view of device package 100 and its antenna 108; FIG. 2B is a top view of device package 100 and its antenna 108; and FIG. 2C is a side view of device package 100 and its antenna 108.

Referring to FIG. 2, antenna 108 includes a main segment 110 and a connecting segment 112, which may be formed of any of various metals or metal composition, e.g., copper (Cu), depending on application and other considerations. Main segment 110 may be formed in any of various patterns, e.g., meandering, to achieve desirable radiation and other performance, e.g., gain, bandwidth characteristics. In some implementations, antenna 108 may include a segment 114, which may be used to support and/or implement the ground loop of antenna 108.

In the example of FIG. 2, antenna 108 is embedded in mold 106. Main segment 110, which has first and second ends 110A and 110B respectively. Connecting segment 112 extends downwardly from first end 110A, through mold 106, terminating in a pin 116 for electrical connection to a pad 118 on a top surface 120 of substrate 104. Pin 116 and pad 118 may be made of any suitable metal or metal composition, e.g., copper (Cu) or composition thereof. Pin 116 may be soldered to pad 118, or electrically coupled by any other suitable means. Pin 116 may be integrally formed with connecting segment 112 or be a separate element suitably joined to connecting segment 112. A feed pad 122, e.g., an interconnection, is electrically coupled to pad 118 via a post 123 extending through substrate 104 to provide an external connection for antenna 108. In an example, feed pad 122 is disposed on a bottom portion of substrate 104. In some implementations, connecting segment 112 may be omitted, and main segment 110 may be directly or indirectly electrically coupled to feed pad 122.

Segment 114, when used, extends downwardly from second end 110B of main segment 110 of antenna 108 for connection to top surface 120 of substrate 104. Segment 114 may be used for additional support of main segment 110 and/or to implement the ground loop of antenna 108. Thus, in the example of FIG. 2, main segment 110 is elevated with respect to substrate 104 via connecting segment 112 and/or segment 114, giving antenna 108 a stilted configuration.

In the example arrangement shown in FIG. 2, antenna 108 is embedded in mold 106. That is, as best shown in FIG. 2C, mold 106 completely encapsulates main segment 110, as well as connecting and support segments 112 and 114 when used. Thus, antenna 108 is completely contained within the footprint of substrate 104 and a space 124 extending vertically upward from substrate 104. The boundary or perimeter of space 124 is defined by the perimeter formed by side walls 126, 128, 130 and 132 of mold 106.

Main segment 110, connecting segment 112 and support segment 114 may be collectively formed by multiple panels, two differently-sized ones of which are indicated by reference numerals 142 and 144, respectively. As best shown in FIGS. 2A and 2B, the panels may all be of the same thickness, but may vary in terms of their length and width dimensions. The panels may be assembled to form any of various shapes using low-cost, panel-based, gang-antenna assembly. Main segment 110 may be formed in a serpentine shape, for example, as shown in FIGS. 2A and 2B. The shape of main segment 110 may be determined based on the antenna application, as well as target performance and/or radiation characteristics. Connecting segment 112 may be a single panel, as shown in FIGS. 2A and 2B. In an example, main segment 110 may be a continuous piece.

Figure 3A:
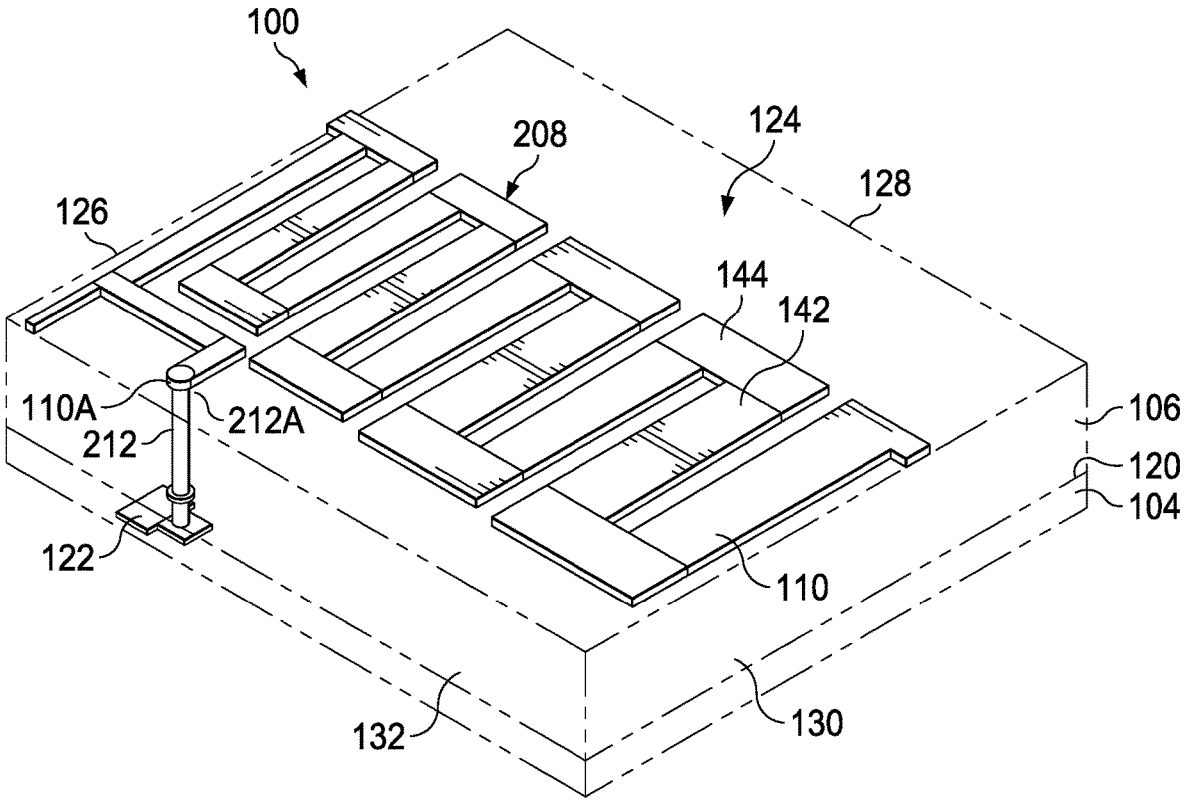
FIGS. 3A, 3B and 3C are perspective, top and side views, respectively, of a device package with a main segment of an antenna formed over a mold of the package.
Figure 3B:
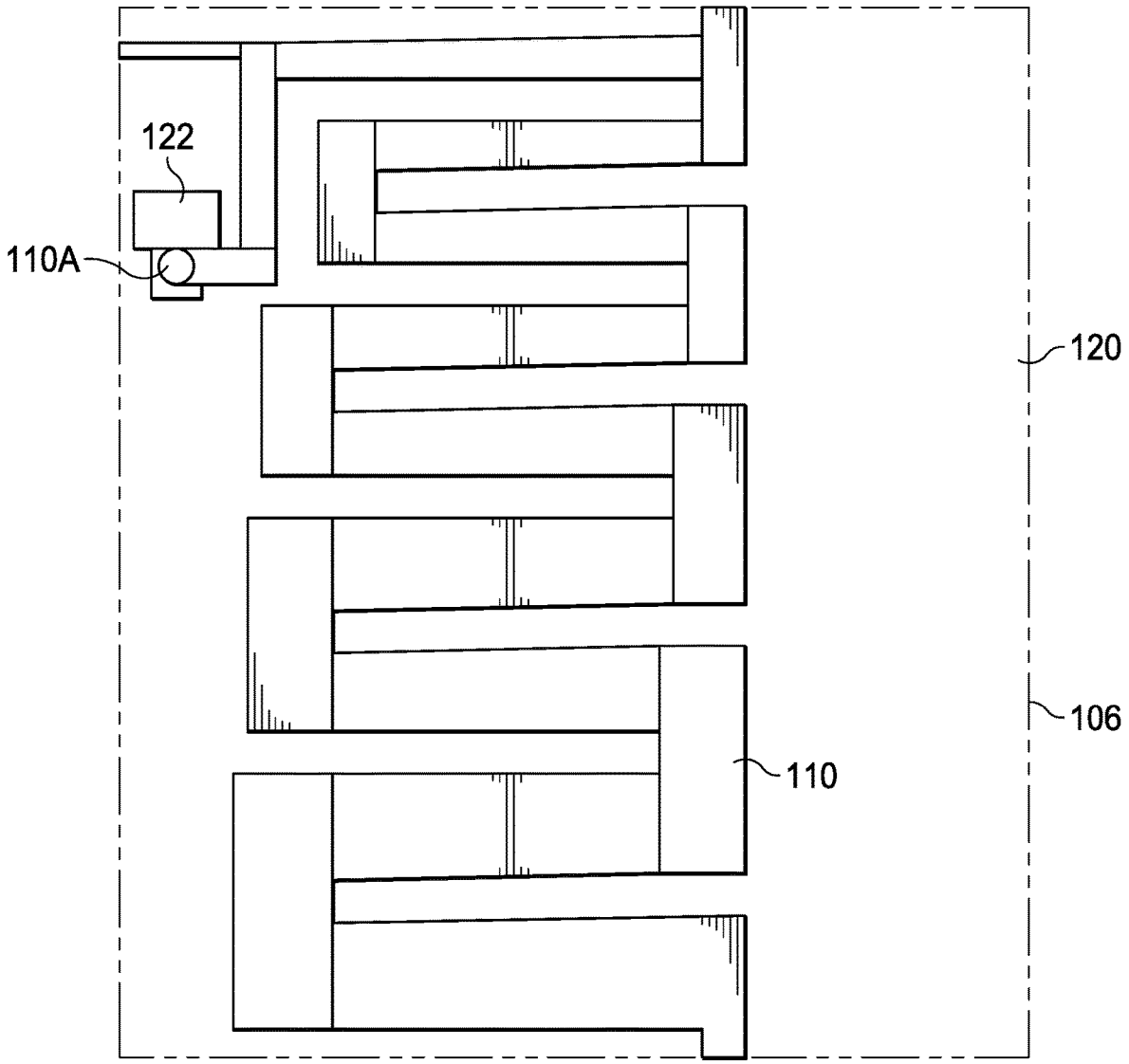
Figure 3C:
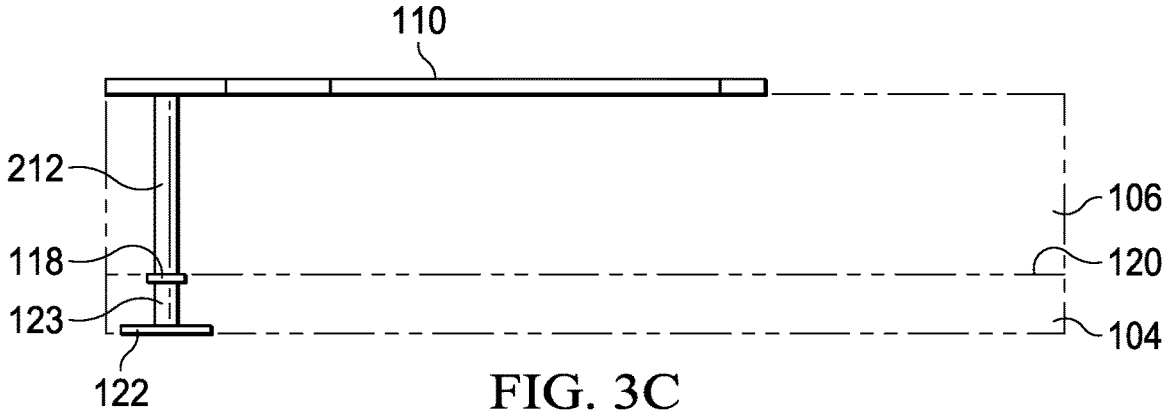

FIGS. 3A, 3B and 3C (collectively, FIG. 3) are diagrams of device package 100 and its antenna 208 configured and arranged according to another example. FIG. 3A is a perspective view of device package 100 and its antenna 208; FIG. 3B is a top view of device package 100 and its antenna 208; and FIG. 3C is a side view of device package 100 and its antenna 208.

The example of FIG. 3 is directed to a stilted antenna configuration in which main segment 110 of antenna 208 is formed over mold 106. In the arrangement illustrated in FIG. 3, there is no segment corresponding to segment 114 in the example of FIG. 2. In the example of FIG. 3, main segment 110 is fully supported by mold 106.

Also, in the example of FIG. 3, a post 212 is used to couple main segment 110 to substrate 104 and feed pad 122. The top 212A of post 212 may be physically connected or electrically coupled to first end 110A of main segment 110. From top 212A, post 212 extends downwardly through mold 106 and is coupled, e.g., soldered, to pad 118 on top surface 120 of substrate 104. Feed pad 122 may be electrically coupled to pad 118 via post 123 extending through substrate 104 to provide an external connection for antenna 208. In an example, post 212 may be omitted, and main segment 110 may be directly or indirectly electrically coupled to feed pad 122.

Thus, in the example shown in FIG. 3, antenna 208 is completely contained within the footprint of substrate 104 and space 124 extending vertically upward from the footprint of substrate 104. The boundary or perimeter of space 124 is defined by the perimeter formed by side walls 126, 128, 130 and 132 of mold 106.

In the example of FIG. 3, main segment 110 may be formed by arranging multiple panels, two differently sized ones of which are indicated by reference numerals 142 and 144, respectively. As in the example of FIG. 2, the panels themselves may have different lengths and widths and may be assembled to form any of various shapes using low-cost, panel-based, gang-antenna assembly. Main segment 110 may be formed in a serpentine shape, for example, as shown in FIGS. 3A and 3B. The shape of main segment 110 may be determined based on the particular application, as well as performance and/or radiation characteristics for that application. In an example, main segment 110 may be a continuous piece.

Figure 4A:
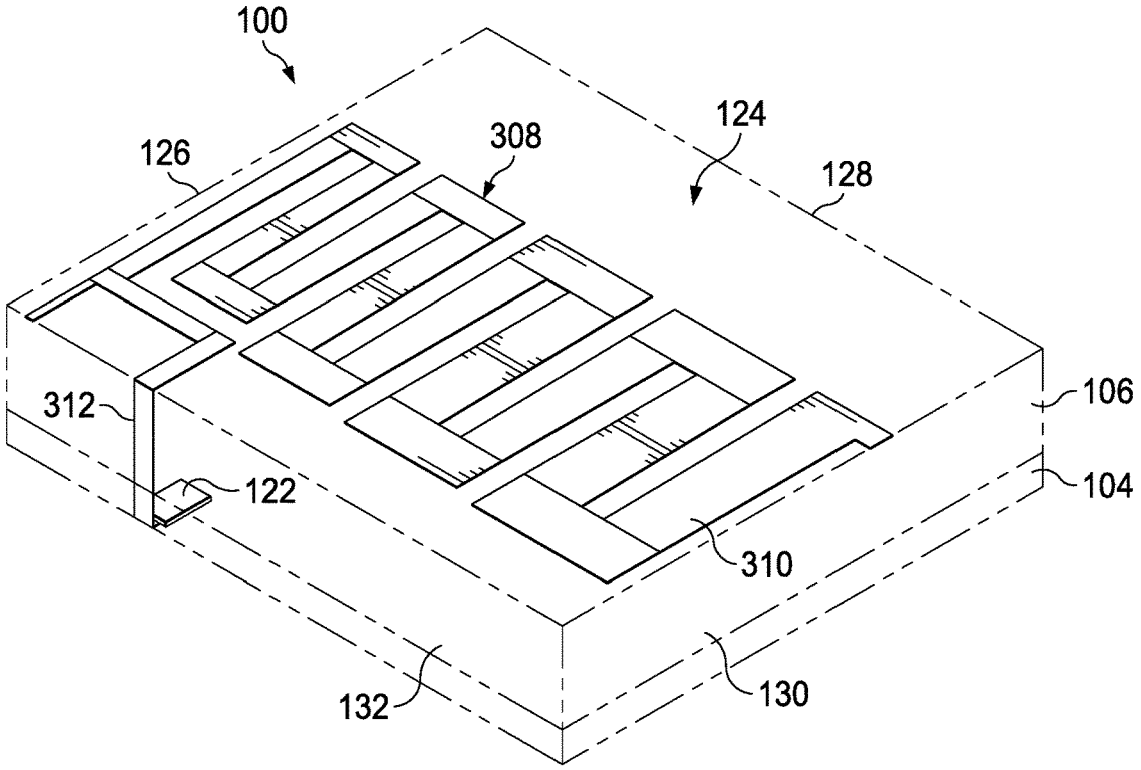
FIGS. 4A, 4B and 4C are perspective, top and side views, respectively, of a device package with a main segment of an antenna formed over a mold of the package using a deposition process.
Figure 4B:
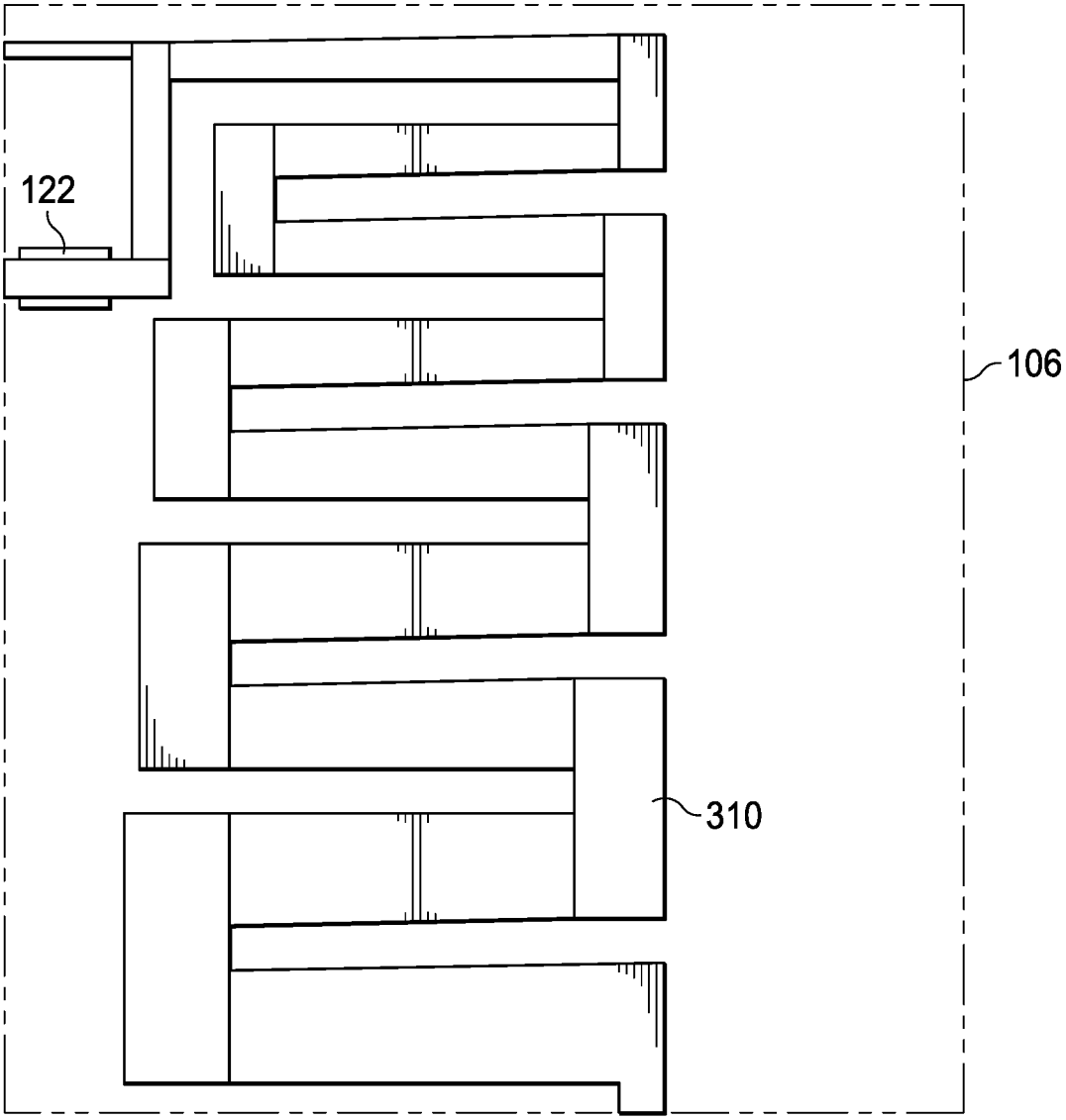
Figure 4C:
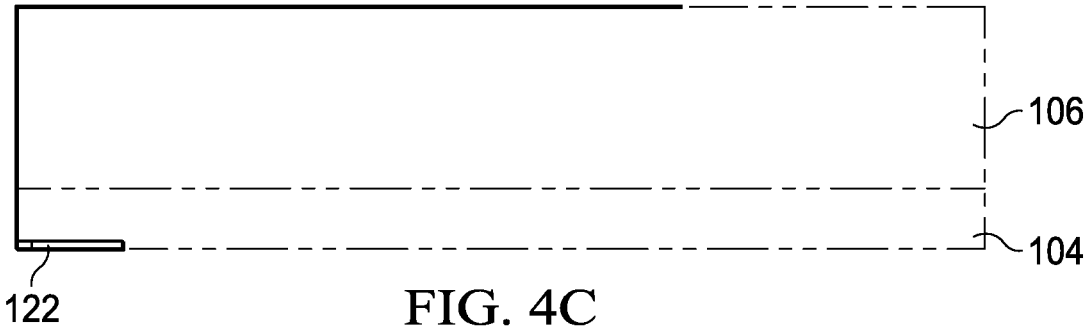

FIGS. 4A, 4B and 4C (collectively, FIG. 4) are diagrams of device package 100 and its antenna 308 configured and arranged according to yet another example. In the example of FIG. 4, antenna 308 is formed on or over mold 106 via a deposition process. That is, a metal composition, e.g., copper (Cu) composition, may be deposited on mold 106 using one or more metal sputter processes to form antenna 308. Other suitable deposition processes, as well as printing processes, may be used to form antenna 308. For example, antenna 308 may be deposited on mold 106 using an ink-jet printing process.

A main segment 310 of antenna 308 is deposited on top of mold 106, and a connecting segment 312 of antenna 308 is deposited along a side wall, e.g., side wall 132, of mold 106. Connecting segment 312 connects antenna 308 to feed pad 122 on a bottom surface of substrate 104. Main segment 310 and connecting segment 312 may be formed by one continuous deposition process to form antenna 308 as a continuous strip. In an example, connecting segment 312 may be omitted, and main segment 310 may be directly or indirectly electrically coupled to feed pad 122.

In the example of FIG. 4, antenna 308 of device package 100 is formed entirely on outer surfaces of mold 106 by metal sputtering, printing or other suitable deposition process. In this example, connecting segment 312 is considered part of the side wall on which it is formed. Thus, antenna 308 is completely contained within the footprint of substrate 104 and space 124 extending vertically upward from substrate 104 via side walls 126, 128, 130 and 132 of mold 106.

Figure 5:
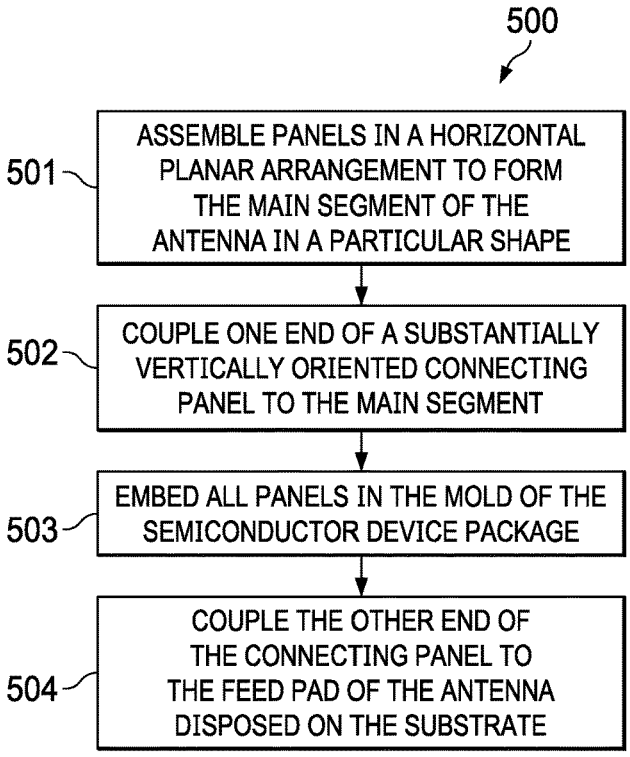
FIG. 5 is a flow diagram of an example method of forming an antenna in a mold of a device package.

FIG. 5 is a flow diagram of an example method 500 of forming an antenna in a mold of a device package. FIG. 5 is described with additional reference to FIG. 2.

In block 501, a plurality of panels, such as those shown in FIG. 2, are assembled in a horizontal planar arrangement to form main segment 110 of antenna 108. The panels of main segment 110 may be arranged in any of various configurations to give main segment 110 a desired shape. Alternatively, main segment 110 may a continuous piece formed into a desired shape. The particular shape may be determined based on desired performance characteristics, e.g., radiation efficiency, gain, of antenna 108. In block 502, one end of another panel constituting connecting segment 112 is coupled to main segment 110. Connecting segment panel 112 is oriented substantially vertical to main segment 110. Main and connecting segments 110 and 112, including all panels from which they are formed, are embedded in mold 106 in block 503. In block 504, the other end of connecting segment panel 112 is coupled to feed pad 122 of antenna 108. Feed pad 122 may be formed on the bottom surface of substrate 104.

Figure 6:
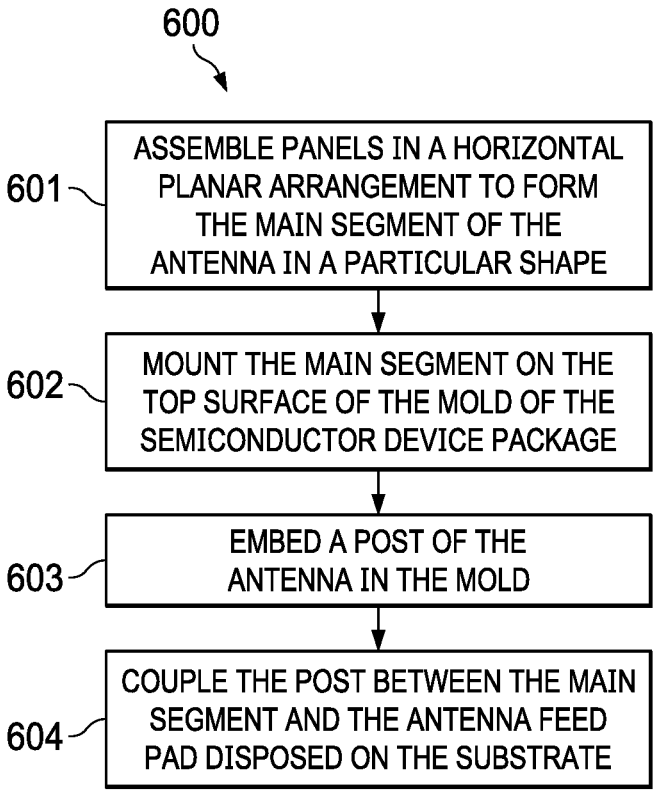
FIG. 6 is a flow diagram of an example method of forming a main segment of an antenna on top of a mold of a device package.

FIG. 6 is a flow diagram of an example method 600 of forming a main segment of an antenna on top of a mold of a device package. FIG. 6 is described with additional reference to FIG. 3.

In block 601, a plurality of panels, such as those shown in FIG. 3, are assembled in a horizontal planar arrangement to form main segment 110 of antenna 208. As in the example of FIG. 2, the panels may be assembled in any of various different ways to give main segment 110 a desired shape, which may be determined based on desired performance characteristics, e.g., radiation efficiency, gain, of antenna 208. Alternatively, main segment 110 may be a continuous piece formed into a desired shape. In block 602, main segment 110 is mounted on the top surface of mold 106 of device package 100. The mounting may be performed in any suitable way. In block 603, post 212 is embedded in mold 106 and positioned in a substantially vertical orientation with respect to substrate 104. In block 604, post 212 is coupled between main segment 110 and antenna feed pad 122 disposed on the bottom surface of substrate 104.

Figure 7:
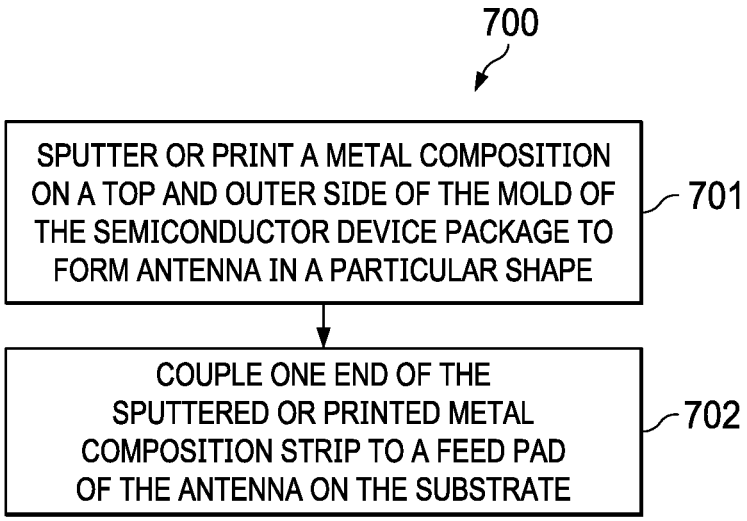
FIG. 7 is a flow diagram of an example method of forming an antenna over a mold of a device package.

FIG. 7 is a flow diagram of an example method 700 of forming an antenna over a mold of a device package. FIG. 7 is described with additional reference to FIG. 3.

In block 701, a metal composition, e.g., a copper (Cu) composition, is deposited on a top and outer side of mold 106 to form antenna 308 in a desired shape. For example, as shown in FIG. 3, antenna 308 may be formed on the top surface of mold 106 and on side wall 132. The metal composition may be deposited using one or more metal sputtering processes or one or more ink-jet printing processes. Other deposition processes consistent with the teachings herein may be used as well. The deposition, e.g., metal sputtering, ink-jet printing, may be carried out to form antenna 308 as a continuous strip. Alternatively, such deposition may be performed individually for each of multiple segments of antenna 308. In block 702, one end of the deposited metal composition, e.g., the lower end on side wall 132, is coupled to antenna feed pad 122 disposed on the bottom surface of substrate 104.

Each of the flow diagrams of FIGS. 5-7 depict one possible order of operations to achieve a particular arrangement of a device package integrated antenna. Each of the processes may be performed in a different order than that described. Some operations may be combined into a single operation. Additional may be performed as well.

Various examples of a device package integrated antenna that utilizes three-dimensional space within the device package to achieve further miniaturization without sacrificing antenna performance are provided. The antenna may be formed in any of various configurations to achieve state-of-the art performance and/or radiation characteristics. Antenna function may be fully integrated within a vertically extending footprint of the package. The antenna interface couplings may be contact or contactless. The antenna may be formed using known manufacturing processes, such as metal sputtering, ink-jet printing and low-cost, panel-based, gang-antenna assembly. In some examples, a device package may include multiple antennas.

Modifications of the described examples are possible, as are other examples, within the scope of the claims. Moreover, the teachings herein may be applied in other environments and applications.

What is claimed is:

1. A semiconductor device package, comprising:

a substrate including circuitry and an interconnect;

a mold having a footprint on a surface of the substrate;

an antenna including a planar strip segment electrically coupled to the interconnect, in which the planar strip segment is within the footprint, and at least a part of the mold is between the planar strip segment and the surface of the substrate; and a second segment that extends from an end of the planar strip segment to the surface of the substrate, wherein the second segment is electrically coupled between the planar strip segment and the interconnect.

2. The semiconductor device package of claim 1, wherein the planar strip segment and the second segment are embedded in the mold.

3. The semiconductor device package of claim 1, wherein the planar strip segment is on a surface of the mold facing away from the substrate.

4. The semiconductor device package of claim 1, wherein the planar strip segment includes panels.

5. The semiconductor device package of claim 1, wherein the end is a first end, and the semiconductor device package further comprises a third segment that extends from a second end of the planar strip segment to the surface.

6. The semiconductor device package of claim 1, wherein the planar strip segment includes a serpentine segment.

7. The semiconductor device package of claim 1, wherein the interconnect includes a pad on the surface of the substrate.

8. The semiconductor device package of claim 7, wherein the surface is a first surface, and the substrate has a second surface opposite to the first surface; and wherein the pad is a first pad, and the interconnect includes:

a second pad on the second surface; and a post that extends through a thickness of the substrate and electrically couples between the first and second pads.

9. The semiconductor device package of claim 1, wherein the planar strip segment includes Copper.

10. A device, comprising:

a semiconductor device package including a substrate, the substrate including circuitry and an interconnect;

a mold on a surface of the substrate;

an antenna including a planar strip segment electrically coupled to the interconnect, in which the planar strip segment is within a footprint of the mold, and at least a part of the mold is between the planar strip segment and, the surface of the substrate; and a second segment that extends from an end of the planar strip segment to the surface of the substrate, wherein the second segment is electrically coupled between the planar strip segment and the interconnect.

11. The device of claim 10, wherein the planar strip segment is embedded within the mold.

12. The device of claim 10, wherein the planar strip segment is on a surface of the mold facing away from the substrate.

13. A method, comprising:

receiving a semiconductor device package including a substrate, the substrate including circuitry and an interconnect;

forming a mold on a surface of the substrate;

forming a planar strip segment of an antenna within a footprint of the mold, in which at least a part of the mold is between the planar strip segment and the surface of the substrate; and forming a second segment that extends from an end of the planar strip segment to the surface of the substrate to electrically couple between the planar strip segment and the interconnect.

14. The method of claim 13, wherein forming the planar strip segment of the antenna comprises:

assembling a plurality of panels into a particular shape and parallel to the surface of the substrate.

15. The method of claim 14, further comprising:

embedding the panels in the mold.

16. The method of claim 14, wherein assembling of the plurality of panels comprises:

forming the plurality of panels on a surface of the mold.

17. The method of claim 14, further comprising:

embedding the second segment in the mold; and electrically coupling the second segment to the interconnect.

18. The method of claim 13, wherein forming the planar strip segment comprises:

forming a metal layer on a surface of the mold.

19. The method of claim 18, wherein forming the metal layer comprises:

performing one or more metal sputtering processes on the surface of the mold.

20. The method of claim 18, wherein the forming the metal layer on the surface of the mold comprises:

printing the metal layer on the surface of the mold.

* * * * *